US008378240B2

(12) United States Patent
Rajagopal et al.

(10) Patent No.: US 8,378,240 B2
(45) **Date of Patent: *Feb. 19, 2013**

(54) TWO-STAGE SWITCH ASSEMBLY

(75) Inventors: Vijai Rajagopal, Waterloo (CA); James Infanti, Waterloo (CA); Firmansyah Sulem, Waterloo (CA); Timothy Kyowski, Waterloo (CA)

(73) Assignee: Research In Motion Limited, Waterloo (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/529,684

(22) Filed: Jun. 21, 2012

(65) Prior Publication Data

US 2012/0257098 A1 Oct. 11, 2012

Related U.S. Application Data

(63) Continuation of application No. 13/154,074, filed on Jun. 6, 2011, now Pat. No. 8,227,714, which is a continuation of application No. 12/393,774, filed on Feb. 26, 2009, now Pat. No. 7,977,587.

(60) Provisional application No. 61/103,774, filed on Oct. 8, 2008.

(51) Int. Cl.
*H01H 9/00* (2006.01)

(52) U.S. Cl. ..... 200/1 B

(58) Field of Classification Search ..... 361/679.01, 361/807, 825, 837; 200/345, 1 B, 5 A, 341
See application file for complete search history.

(56) References Cited

U.S. PATENT DOCUMENTS

| | | | | |
|---|---|---|---|---|
| 5,510,584 | A * | 4/1996 | Norris | 200/5 A |
| 5,559,311 | A | 9/1996 | Gorbatoff | |
| 6,166,662 | A * | 12/2000 | Chuang | 341/22 |
| 6,303,887 | B1 * | 10/2001 | Ando | 200/512 |
| 6,670,562 | B2 | 12/2003 | Kaneko | |
| 6,809,272 | B2 | 10/2004 | Yamada | |
| 6,880,989 | B2 | 4/2005 | Sotome | |
| 6,995,324 | B2 | 2/2006 | Asada | |
| 7,157,650 | B2 | 1/2007 | Rochon | |
| 7,217,893 | B1 | 5/2007 | Huang et al. | |
| 7,977,587 | B2 * | 7/2011 | Rajagopal et al. | 200/1 B |
| 8,058,571 | B2 * | 11/2011 | Rajagopal et al. | 200/1 B |
| 2006/0181506 | A1 | 8/2006 | Fyke | |
| 2008/0122945 | A1 | 5/2008 | Ahonen | |
| 2008/0138061 | A1 | 6/2008 | Saiki | |
| 2009/0174990 | A1 * | 7/2009 | Ligtenberg et al. | 361/679.01 |

OTHER PUBLICATIONS

Nieto, Jose Miguel; Search Report from corresponding European Application No. 09153826.4; search completed Jun. 16, 2009.

* cited by examiner

*Primary Examiner* — Vanessa Girardi
(74) *Attorney, Agent, or Firm* — Blake, Cassels & Graydon LLP; Wilfred P. So; Brett J. Slaney

(57) ABSTRACT

A switch assembly is provided to actuate a pair of switches using a single push key, e.g. for a camera that utilizes a first switch to activate an image focusing function and a second switch to activate a camera shutter. The switch assembly comprises a contact pad switch and a dome switch that are located laterally to one another. When the push key receives a first downward force, only the contact pad switch becomes activated and a first electric circuit is completed. When the push key receives a second downward force that is greater than the first force, the dome switch collapses and a second electric circuit is completed.

21 Claims, 16 Drawing Sheets

(a)

(b)

(c)

(a)

(b)

(c)

(a)

(b)

TWO-STAGE SWITCH ASSEMBLY

CROSS-REFERENCE TO RELATED APPLICATIONS

This application is a continuation of U.S. patent application Ser. No. 13/154,074 filed on Jun. 6, 2011 and issued as U.S. Pat. No. 8,227,714 on Jul. 24, 2012, which is a continuation of U.S. patent application Ser. No. 12/393,774 filed on Feb. 26, 2009 and issued as U.S. Pat. No. 7,977,587 on Jul. 12, 2011, which claims priority from U.S. Provisional Application No. 61/103,774, filed on Oct. 8, 2008, all of which are hereby incorporated by reference.

TECHNICAL FIELD

The following relates generally to switches, and more particularly to two-stage electrical switches.

DESCRIPTION OF THE RELATED ART

In electronic devices, such as digital cameras devices, there may be different functions corresponding to various keys with which the user interacts. For example, in a camera device, one key may allow the user to control the on/off functionality, while an ancillary key controls the camera shutter. As the number of functions of electronic devices increases, it is expected that the number of user control keys would also increase, which can lead to over crowding of keys and increased user interface complexity.

There are various switch devices that combine two separate switches into a single key. For example, a camera device may provide the focusing function and the camera shutter function in a single two-stage switch under control of a common push button. Such devices operate by receiving a first downward force on a switch device to activate the focusing function. After the camera device has focused, if the device receives a second downward force greater than the first downward force, the camera shutter function is then activated, thereby capturing an image.

The above devices often utilize a single push button with an actuator protruding from the key to depress a dual action dome switch to first activate the auto-focus, and then the camera shutter. For improved performance, the actuator should be aligned with the dome switch, which can be difficult to control without adding complexity to the device.

When implementing two-stage electrical switches, there may also be difficulty in discerning between the different stage activations through tactile feedback.

BRIEF DESCRIPTION OF THE DRAWINGS

Embodiments will now be described by way of example only with reference to the appended drawings wherein:

FIG. 10(*b*) is a bottom plan view of the push key shown in FIG. 9 in isolation.

FIG. 10(*c*) is a top plan view of the push key shown in FIG. 9 in isolation.

FIG. 12(*b*) is a bottom plan view of the push key shown in FIG. 11 in isolation.

FIG. 12(*c*) is a top plan view of the push key shown in FIG. 11 in isolation.

FIG. 15(*b*) is a top plan view of the lower surface shown in FIG. 9 and FIG. 11 in isolation.

DETAILED DESCRIPTION

Figure 2:
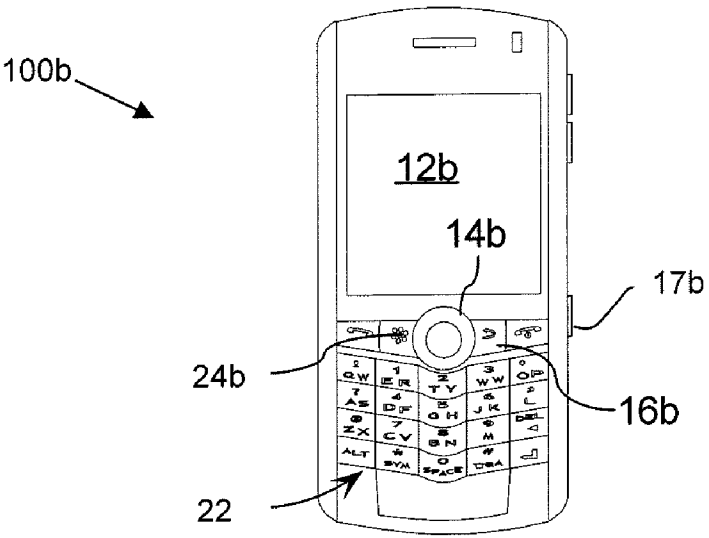
FIG. 2 is a plan view of another mobile device and a display screen therefor.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

In the field of electronic devices, push keys may be used to activate functions within the device. The operation of input devices, for example push keys, may depend on the type of electronic device and the applications of the device.

Examples of applicable electronic devices include pagers, cellular phones, cellular smart-phones, wireless organizers, personal digital assistants, computers, laptops, handheld wireless communication devices, wirelessly enabled notebook computers, camera devices and the like. Such devices will hereinafter be commonly referred to as "mobile devices" for the sake of clarity. It will however be appreciated that the principles described herein are also suitable to other devices, e.g. "non-mobile" devices.

In an embodiment, the mobile device is a two-way communication device with advanced data communication capabilities including the capability to communicate with other mobile devices or computer systems through a network of transceiver stations. The mobile device may also have the capability to allow voice communication. Depending on the functionality provided by the mobile device, it may be referred to as a data messaging device, a two-way pager, a cellular telephone with data messaging capabilities, a wireless Internet appliance, or a data communication device (with or without telephony capabilities).

Figure 1:
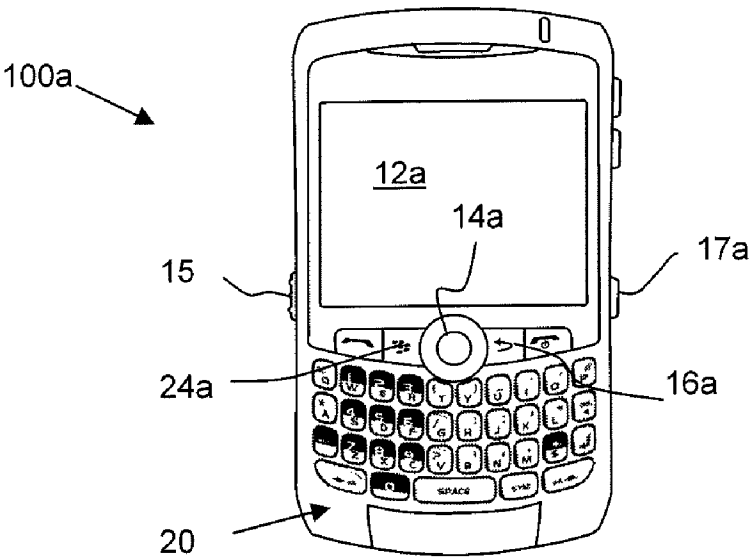
FIG. 1 is a plan view of a mobile device and a display screen therefor.

Referring to FIGS. 1 and 2, one embodiment of a mobile device 100*a* is shown in FIG. 1, and another embodiment of a mobile device 100*b* is shown in FIG. 2. It will be appreciated that the numeral "100" will hereinafter refer to any mobile device 100, including the embodiments 100*a* and 100*b*, those embodiments enumerated above or otherwise. It will also be appreciated that a similar numbering convention may be used for other general features common between all Figures such as a display 12, a positioning device 14, a cancel or escape button 16, a camera button 17, and a menu or option button 24.

The mobile device 100*a* shown in FIG. 1 comprises a display 12*a* and the cursor or view positioning device 14 shown in this embodiment is a trackball 14*a*. Positioning device 14 may serve as another input member and is both rotational to provide selection inputs to the main processor 102 (see FIG. 3) and can also be pressed in a direction generally toward housing to provide another selection input to the processor 102. Trackball 14*a* permits multi-directional positioning of the selection cursor 18 (see FIG. 5) such that the selection cursor 18 can be moved in an upward direction, in a downward direction and, if desired and/or permitted, in any diagonal direction. The trackball 14*a* is in this example situated on the front face of a housing for mobile device 100*a* as shown in FIG. 1 to enable a user to manoeuvre the trackball 14*a* while holding the mobile device 100*a* in one hand. The trackball 14*a* may serve as another input member (in addition to a directional or positioning member) to provide selection inputs to the processor 102 and can preferably be pressed in a direction towards the housing of the mobile device 100*b* to provide such a selection input.

The display 12 may include a selection cursor 18 that depicts generally where the next input or selection will be received. The selection cursor 18 may comprise a box, alteration of an icon or any combination of features that enable the user to identify the currently chosen icon or item. The mobile device 100*a* in FIG. 1 also comprises a programmable convenience button 15 to activate a selected application such as, for example, a calendar or calculator. Further, mobile device 100*a* includes an escape or cancel button 16*a*, a camera button 17*a*, a menu or option button 24*a* and a keyboard 20. The camera button 17 is able to activate photo-capturing functions when pressed preferably in the direction towards the housing. The menu or option button 24 loads a menu or list of options on display 12*a* when pressed. In this example, the escape or cancel button 16*a*, the menu option button 24*a*, and keyboard 20 are disposed on the front face of the mobile device housing, while the convenience button 15 and camera button 17*a* are disposed at the side of the housing. This button placement enables a user to operate these buttons while holding the mobile device 100 in one hand. The keyboard 20 is, in this embodiment, a standard QWERTY keyboard.

The mobile device 100*b* shown in FIG. 2 comprises a display 12*b* and the positioning device 14 in this embodiment is a trackball 14*b*. The mobile device 100*b* also comprises a menu or option button 24*b*, a cancel or escape button 16*b*, and a camera button 17*b*. The mobile device 100*b* as illustrated in FIG. 2, comprises a reduced QWERTY keyboard 22. In this embodiment, the keyboard 22, positioning device 14*b*, escape button 16*b* and menu button 24*b* are disposed on a front face of a mobile device housing. The reduced QWERTY keyboard 22 comprises a plurality of multi-functional keys and corresponding indicia including keys associated with alphabetic characters corresponding to a QWERTY array of letters A to Z and an overlaid numeric phone key arrangement.

It will be appreciated that for the mobile device 100, a wide range of one or more positioning or cursor/view positioning mechanisms such as a touch pad, a positioning wheel, a joystick button, a mouse, a touchscreen, a set of arrow keys, a tablet, an accelerometer (for sensing orientation and/or movements of the mobile device 100 etc.), or other whether presently known or unknown may be employed. Similarly, any variation of keyboard 20, 22 may be used. It will also be appreciated that the mobile devices 100 shown in FIGS. 1 and 2 are for illustrative purposes only and various other mobile devices 100 are equally applicable to the following examples. For example, other mobile devices 100 may include the trackball 14*b*, escape button 16*b* and menu or option button 24 similar to that shown in FIG. 2 only with a full or standard keyboard of any type. Other buttons may also be disposed on the mobile device housing such as colour coded "Answer" and "Ignore" buttons to be used in telephonic communications. In another example, the display 12 may itself be touch sensitive thus itself providing an input mechanism in addition to display capabilities.

To aid the reader in understanding the structure of the mobile device 100, reference will now be made to FIGS. 3 through 6.

Figure 3:
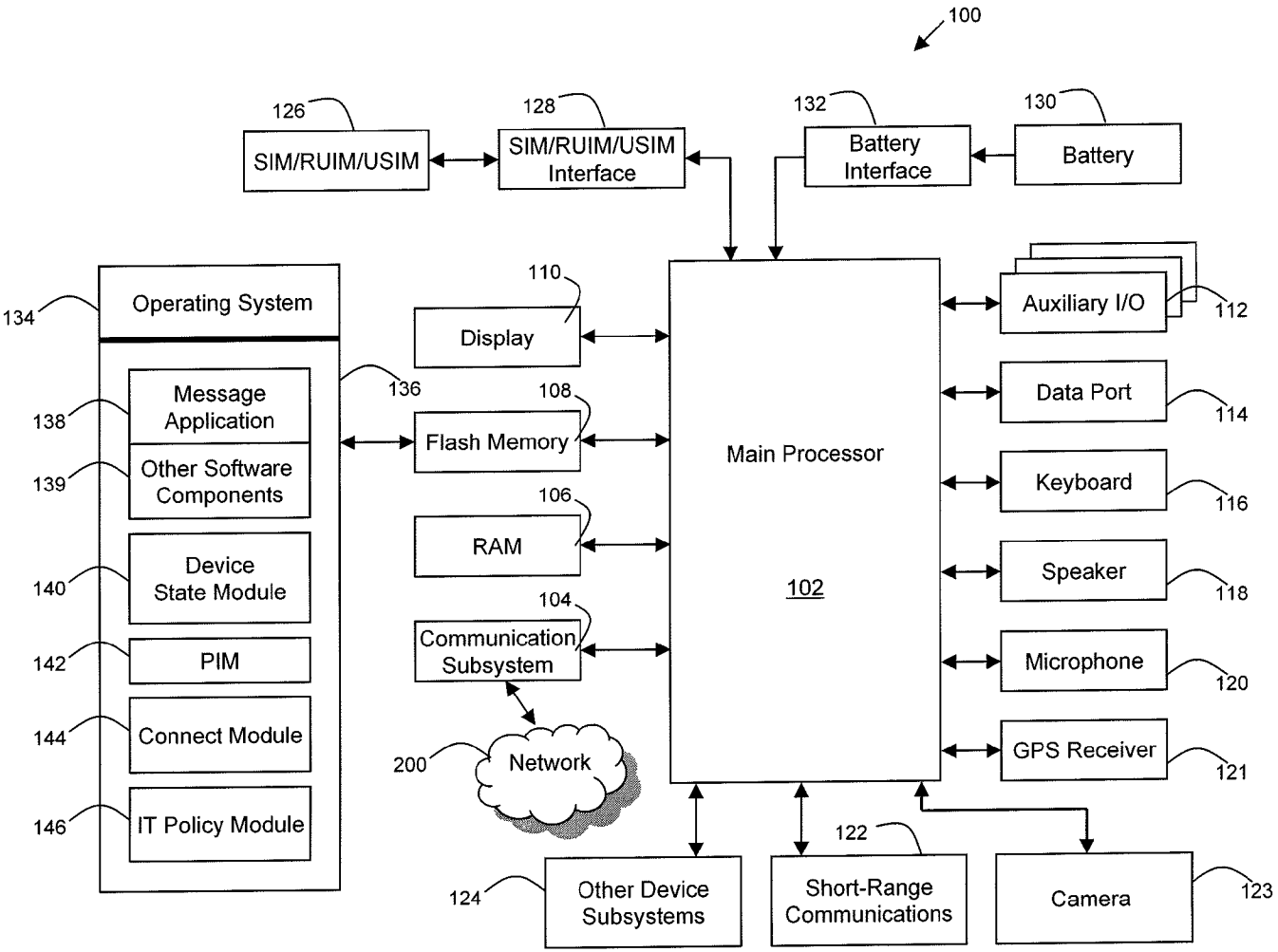
FIG. 3 is a block diagram of an exemplary embodiment of a mobile device.

Referring first to FIG. 3, shown therein is a block diagram of an exemplary embodiment of a mobile device 100. The mobile device 100 comprises a number of components such as a main processor 102 that controls the overall operation of the mobile device 100. Communication functions, including data and voice communications, are performed through a communication subsystem 104. The communication subsystem 104 receives messages from and sends messages to a wireless network 200. In this exemplary embodiment of the mobile device 100, the communication subsystem 104 is configured in accordance with the Global System for Mobile Communication (GSM) and General Packet Radio Services (GPRS) standards, which is used worldwide. Other communication configurations that are equally applicable are the 3G and 4G networks such as EDGE, UMTS and HSDPA, LTE, Wi-Max etc. New standards are still being defined, but it is believed that they will have similarities to the network behaviour described herein, and it will also be understood by persons skilled in the art that the embodiments described herein are intended to use any other suitable standards that are developed in the future. The wireless link connecting the communication subsystem 104 with the wireless network 200 represents one or more different Radio Frequency (RF) channels, operating according to defined protocols specified for GSM/GPRS communications.

The main processor 102 also interacts with additional subsystems such as a Random Access Memory (RAM) 106, a flash memory 108, a display 110, an auxiliary input/output (I/O) subsystem 112, a data port 114, a keyboard 116, a speaker 118, a microphone 120, a GPS receiver 121, short-range communications 122, a camera 123 and other device subsystems 124.

Some of the subsystems of the mobile device 100 perform communication-related functions, whereas other subsystems may provide "resident" or on-device functions. By way of example, the display 110 and the keyboard 116 may be used for both communication-related functions, such as entering a text message for transmission over the network 200, and device-resident functions such as a calculator or task list.

The mobile device 100 can send and receive communication signals over the wireless network 200 after required network registration or activation procedures have been completed. Network access is associated with a subscriber or user of the mobile device 100. To identify a subscriber, the mobile device 100 may use a subscriber module component or "smart card" 126, such as a Subscriber Identity Module (SIM), a Removable User Identity Module (RUIM) and a Universal Subscriber Identity Module (USIM). In the example shown, a SIM/RUIM/USIM 126 is to be inserted into a SIM/RUIM/USIM interface 128 in order to communicate with a network. Without the component 126, the mobile device 100 is not fully operational for communication with the wireless network 200. Once the SIM/RUIM/USIM 126 is inserted into the SIM/RUIM/USIM interface 128, it is coupled to the main processor 102.

The mobile device 100 is a battery-powered device and includes a battery interface 132 for receiving one or more rechargeable batteries 130. In at least some embodiments, the battery 130 can be a smart battery with an embedded microprocessor. The battery interface 132 is coupled to a regulator (not shown), which assists the battery 130 in providing power V+ to the mobile device 100. Although current technology makes use of a battery, future technologies such as micro fuel cells may provide the power to the mobile device 100.

The mobile device 100 also includes an operating system 134 and software components 136 to 146 which are described in more detail below. The operating system 134 and the software components 136 to 146 that are executed by the main processor 102 are typically stored in a persistent store such as the flash memory 108, which may alternatively be a read-only memory (ROM) or similar storage element (not shown). Those skilled in the art will appreciate that portions of the operating system 134 and the software components 136 to 146, such as specific device applications, or parts thereof, may be temporarily loaded into a volatile store such as the RAM 106. Other software components can also be included, as is well known to those skilled in the art.

The subset of software applications 136 that control basic device operations, including data and voice communication applications, may be installed on the mobile device 100 during its manufacture. Software applications may include a message application 138, a device state module 140, a Personal Information Manager (PIM) 142, a connect module 144 and an IT policy module 146. A message application 138 can be any suitable software program that allows a user of the mobile device 100 to send and receive electronic messages, wherein messages are typically stored in the flash memory 108 of the mobile device 100. A device state module 140 provides persistence, i.e. the device state module 140 ensures that important device data is stored in persistent memory, such as the flash memory 108, so that the data is not lost when the mobile device 100 is turned off or loses power. A PIM 142 includes functionality for organizing and managing data items of interest to the user, such as, but not limited to, e-mail, contacts, calendar events, and voice mails, and may interact with the wireless network 200. A connect module 144 implements the communication protocols that are required for the mobile device 100 to communicate with the wireless infrastructure and any host system, such as an enterprise system, that the mobile device 100 is authorized to interface with. An IT policy module 146 receives IT policy data that encodes the IT policy, and may be responsible for organizing and securing rules such as the "Set Maximum Password Attempts" IT policy.

Other types of software applications or components 139 can also be installed on the mobile device 100. These software applications 139 can be pre-installed applications (i.e. other than message application 138) or third party applications, which are added after the manufacture of the mobile device 100. Examples of third party applications include games, calculators, utilities, etc.

The additional applications 139 can be loaded onto the mobile device 100 through at least one of the wireless network 200, the auxiliary I/O subsystem 112, the data port 114, the short-range communications subsystem 122, or any other suitable device subsystem 124.

The data port 114 can be any suitable port that enables data communication between the mobile device 100 and another computing device. The data port 114 can be a serial or a parallel port. In some instances, the data port 114 can be a USB port that includes data lines for data transfer and a supply line that can provide a charging current to charge the battery 130 of the mobile device 100.

For voice communications, received signals are output to the speaker 118, and signals for transmission are generated by the microphone 120. Although voice or audio signal output is accomplished primarily through the speaker 118, the display 110 can also be used to provide additional information such as the identity of a calling party, duration of a voice call, or other voice call related information.

Figure 4:
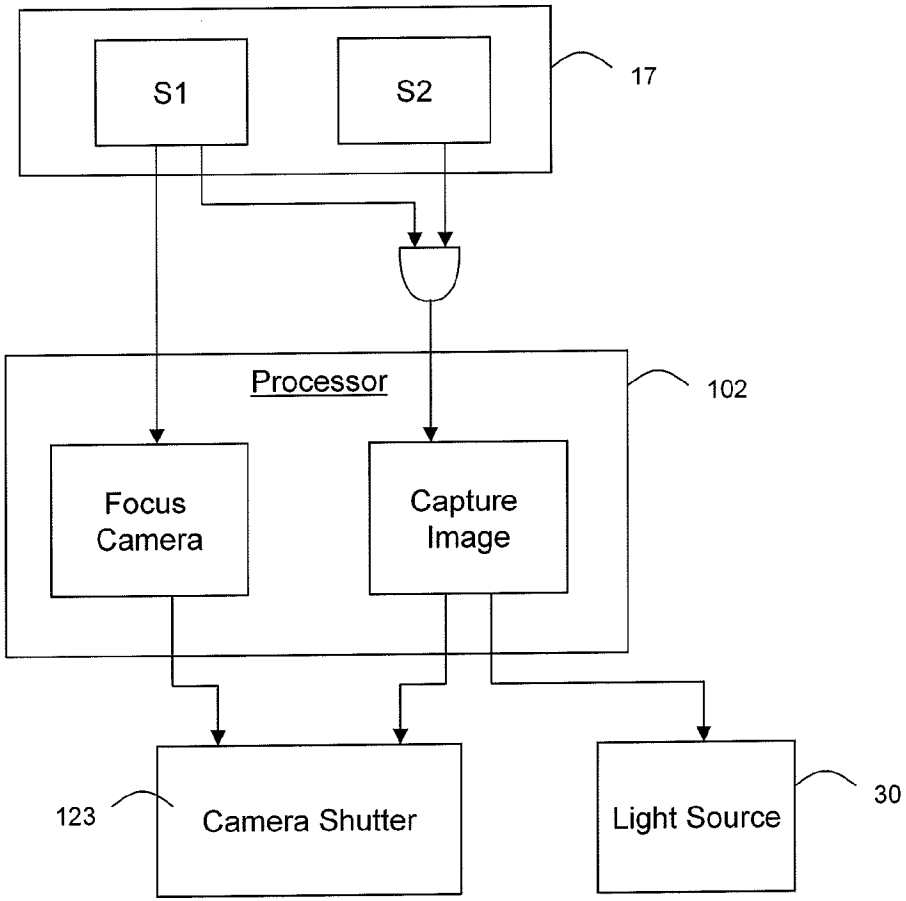
FIG. 4 is a block diagram of an exemplary embodiment of an electronic circuit for a camera system.

Referring to FIG. 4, a representation of an electrical diagram is shown for a camera device. The camera button 17 in this representation comprises two switches, S1 and S2. The activation of switch S1 alone may initiate the camera focusing functionality within the processor 102 and camera shutter 123. The combined activation of switches S1 and S2 may activate the process to capture an image, which may comprise activating the camera shutter 123 and creating a flash of light from a light source 30. In a general two-stage camera button 17, the first switch S1 is activated first to focus the camera, followed by the activation of the second switch S2 to capture the image. It is appreciated that S1 remains active while S2 is activated.

Figure 5:
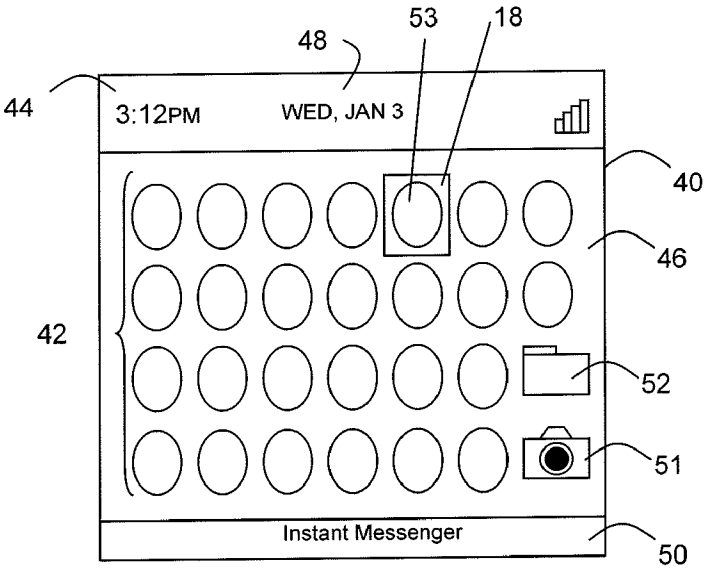
FIG. 5 is a screen shot of a home screen displayed by the mobile device.

Turning now to FIG. 5, the mobile device 100 may display a home screen 40, which can be set as the active screen when the mobile device 100 is powered up and may constitute the main ribbon application. The home screen 40 generally comprises a status region 44 and a theme background 46, which provides a graphical background for the display 12. The theme background 46 displays a series of icons 42 in a predefined arrangement on a graphical background. In some themes, the home screen 40 may limit the number icons 42 shown on the home screen 40 so as to not detract from the theme background 46, particularly where the background 46 is chosen for aesthetic reasons. The theme background 46 shown in FIG. 5 provides a grid of icons. It will be appreciated that preferably several themes are available for the user to select and that any applicable arrangement may be used. An exemplary icon may be a camera icon 51 used to indicate the camera application. One or more of the series of icons 42 is typically a folder 52 that itself is capable of organizing any number of applications therewithin.

The status region 44 in this embodiment comprises a date/time display 48. The theme background 46, in addition to a graphical background and the series of icons 42, also comprises a status bar 50. The status bar 50 provides information to the user based on the location of the selection cursor 18, e.g. by displaying a name for the icon 53 that is currently highlighted.

An application, such as message application 138 may be initiated (opened or viewed) from display 12 by highlighting a corresponding icon 53 using the positioning device 14 and providing a suitable user input to the mobile device 100. For example, message application 138 may be initiated by moving the positioning device 14 such that the icon 53 is highlighted by the selection box 18 as shown in FIG. 5, and providing a selection input, e.g. by pressing the trackball 14*b*.

Figure 6:
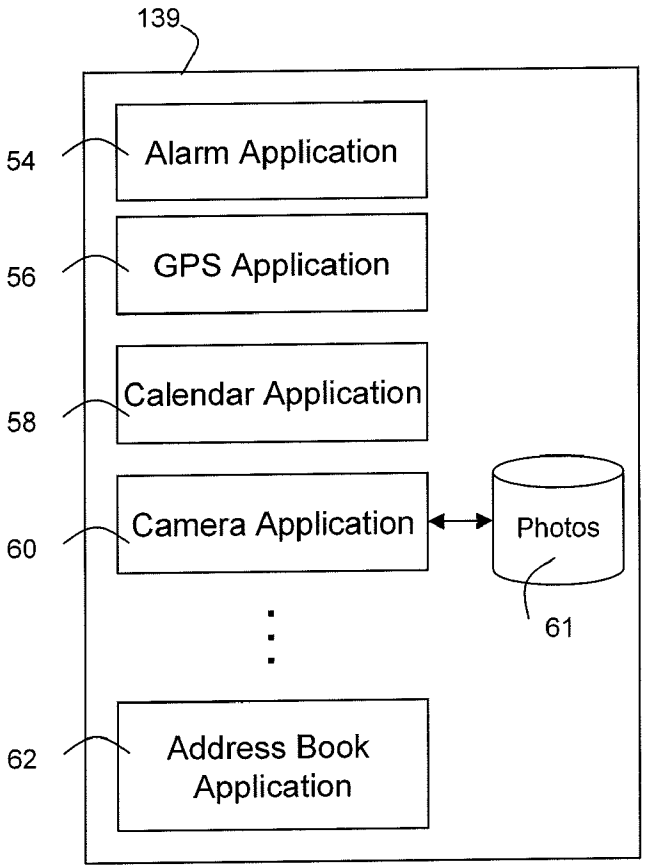
FIG. 6 is a block diagram illustrating exemplary ones of the other software applications and components shown in FIG. 4.

FIG. 6 shows an example of the other software applications and components 139 that may be stored and used on the mobile device 100. Only examples are shown in FIG. 6 and such examples are not to be considered exhaustive. In this example, an alarm application 54 may be used to activate an alarm at a time and date determined by the user. A GPS application 56 may be used to determine the location of a mobile device. A calendar application 58 that may be used to organize appointments. Another exemplary application is a camera application 60 that may be used to focus an image, capture the image into a digital photo, and store the photo for later viewing in a photo or image memory 61 or similar storage device. Another application shown is an address book 62 that is used to store contact information which may include, for example, a phone number, name and e-mail address.

Figure 7:
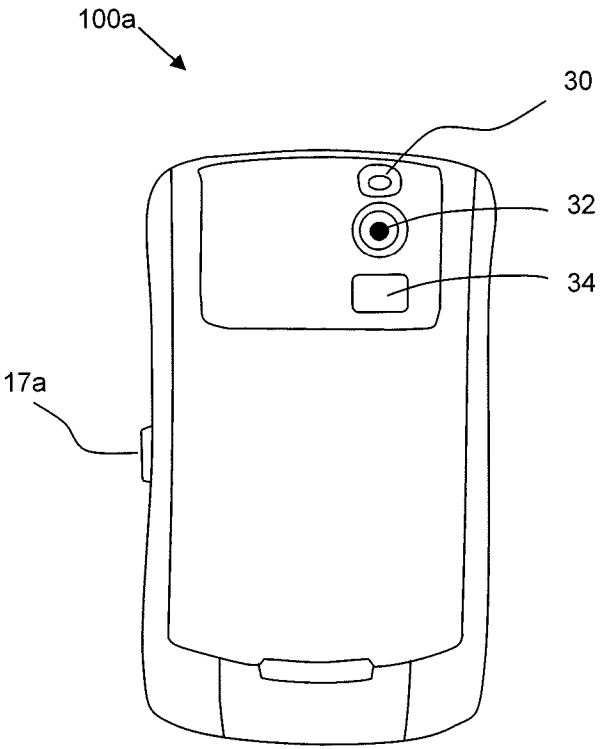
FIG. 7 is a plan view of the back face of the mobile device shown in FIG. 1, and a camera device therefor.

Referring to FIG. 7, the camera application 60 interacts with the structure of the mobile device as shown in one embodiment of a mobile device's rear face. In the rear portion of mobile device 100*a*, for example, there is a light source 30 which may be used to illuminate an object for taking a photo. Also situated on the mobile device's rear face in this example is a camera lens 32 and a reflective surface 34. The camera lens 32 allows the light that represents an image to enter into the camera device. The reflective surface 34 displays an image that is representative of the camera device's view and assists, for example, a user to take a self-portrait photo.

The camera application 60 may be activated by pressing a camera button 17, such as the camera button 17*a* shown in FIG. 7. When a first force is applied to the button 17*a*, the camera application 60 may focus the image entering the camera lens 32. The image is typically focused to allow various objects in the image to appear more clearly. When the camera button 17*a* receives a second force that is greater than the first force, then the light source 30 may turn on for a brief moment of time, while the camera shutter captures the image as viewed by the camera lens 32. The camera application 60 then stores the captured image as a digital photo in the photo memory 61.

Figure 8:
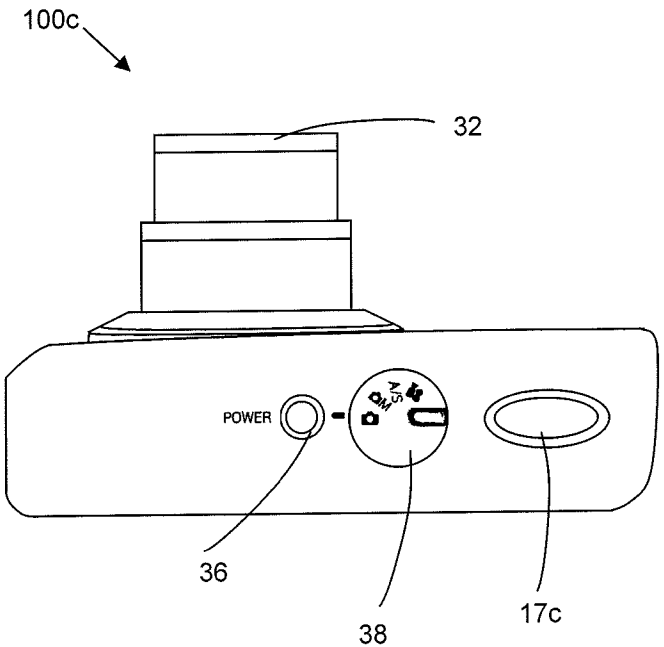
FIG. 8 is a plan view of another electronic device.

The two-stage camera button 17 may also be used on various other devices, such as a dedicated camera including, for example, the camera 100*c* shown in FIG. 8. The camera 100*c* in FIG. 8 also includes the two-stage camera button 17*c* that may function by, in the first stage, focusing the image upon receiving a first force. In the second stage, after receiving a second force greater than the first, the button 17 may activate a camera shutter to capture the image into a digital photo. The camera device 100*c* in this example also comprises a lens 34, an on/off or power button 36, and a selection wheel 38 that may be used to select different operating modes.

It may be appreciated that a two-stage button 17 may be used in other devices for various applications that require a two-stage operation, and the principles described herein should not be limited to only activating camera focusing and shutter functions. Other devices and applications may include, for example, setting the time on a watch. In such an example, the first stage on the button may be used to advance the time, while the second stage on the button may be used to select and set a certain time. Other applications for the two-stage button 17 may also be used for video recording applications, flash-camera shutter combinations and scroll-through media.

Figure 9:
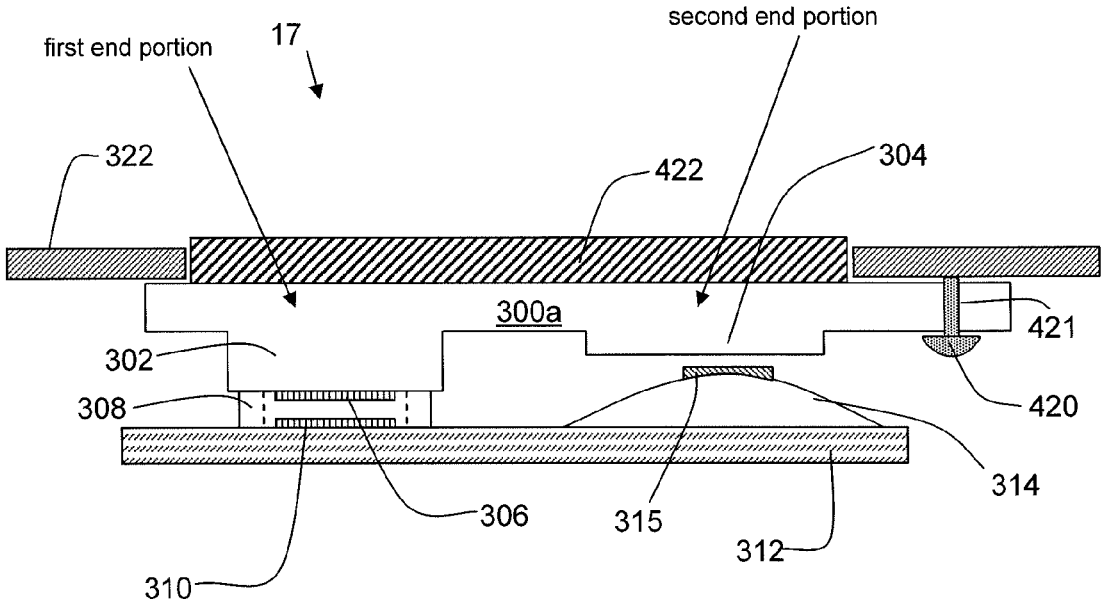
FIG. 9 is a profile view of an exemplary embodiment of a two-stage switch device.

Turning now to FIG. 9, the two-stage camera button 17 comprises a dome switch and conductive pad switch arranged laterally in an array rather than being incorporated into a vertically aligned stack. The dome switch and conductive pad switch may be, but in some embodiments need not be, positioned generally side by side and generally within a similar plane. The button 17 shown in FIG. 9 is shown in a neutral or rest position in relation to the external casing 322 of a mobile device 100. Both the conductive pad 306 and the dome switch 314 are activated by a common push key 300. The push key 300 has a broad outwardly facing (exterior) surface to receive a force for activating the camera button 17. In one embodiment of a general push key 300 configuration, a push key's 300*a* top surface may be secured to a rigid key cap 422, wherein the key cap 422 may distribute a force over the surface of the push key 300*a*. The push key 300*a* may also comprise a hole 421 located to the periphery for a heat staking structure 420. Further detail regarding the application of the heat staking structure 420 is discussed below. It may be noted that the push key 300 is advantageously made of resilient material that can deform and later return to its original shape to permit actuation without requiring inward travel of the entire unit. Examples of such resilient material include, without limitation, various plastics, rubbers, silicones, synthetic compositions and polymers.

The camera button 17 may be configured to include two adjacent, laterally spaced regions, namely a contact switch region and a dome switch region. The contact switch region in this example comprises the protrusion 302 of the push key 300, to which a resilient ring 308 and conductive contact pad 306 are attached. Facing opposite the contact pad 306, and also within the contact switch region, is a contact gap 310 that is attached to a lower surface 312. As will be discussed in further detail below, the contact gap 310 may comprise conductive terminals separated by a space such that when a conductive element, such as the contact pad 310, contacts both conductive terminals, then a circuit is completed. The dome switch region of the camera button 17 comprises the protruding broad surface 304 that is aligned with the dome switch 314. The dome switch 314 is positioned on the same lower surface 312 as the adjacent contact gap 310. In the embodiment shown in FIG. 9, the top of the dome switch 314 may have attached or integrally formed a puck 315. Generally, the puck 315 is a structure that is at least partially rigid with a flat top to engage the protruding broad surface 304. It may be noted that, as exemplified by FIG. 9, the protruding broad surface 304 in the dome region may be distinct from the downward protrusion 302 in the contact switch region and each surface 302, 304 actuates one stage of operation according to the extent of the received force.

It is appreciated that the contact gap 310 may not necessarily be supported by the lower surface 312. For example, in another embodiment not shown, the contact gap 310 is supported below the contact pad 306 by the resilient ring 308.

Figure 20:
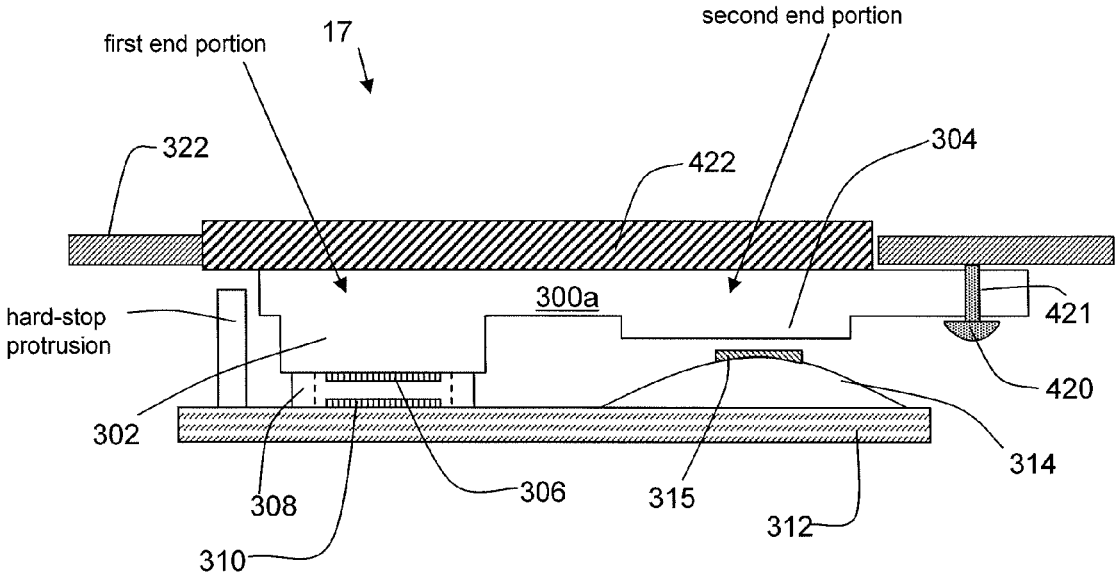
FIG. 20 is a profile view of an exemplary embodiment of a two-stage switch with a hard-stop protrusion.

In other embodiments, such as in FIG. 20, a hard-stop protrusion may be spaced below the key cap 422 in the vicinity of the contact switch region. The hard-stop protrusion is a rigid structure that is shaped or positioned to allow the key cap 422 to travel sufficiently downwards such that the contact pad 306 engages the contact gap 310 to close the contact switch. However, when the push key 300 or key cap 42 continues to receive further downward force after closing the contact switch, the hard-stop protrusion abuts against the bottom surface of the key cap 422 to prevent one side of the key cap from moving downwards any further. This in effect, creates a physical and tactile hard-stop in the contact switch region. From the user's perspective, for example, upon the key cap 422 engaging the hard-stop protrusion, the user's finger may begin to slide laterally and downwards along the key cap 422 towards the dome switch region. It can be appreciated that the hard-stop protrusion may extend from the external casing 322, the lower surface 312, an internal casing (not shown), or any other structure that can support the force acting on the hard-stop protrusion. The hard-stop protrusion may be used with various embodiments of the button 17.

Figure 10:
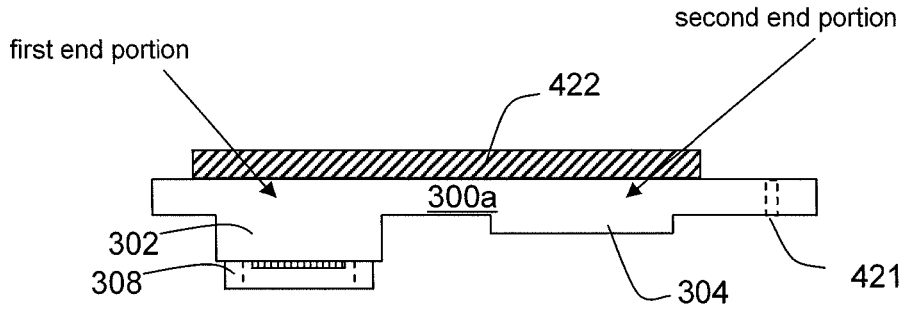
FIG. 10(*a*) is a profile view of the push key shown in FIG. 9 in isolation.
Figure 10:
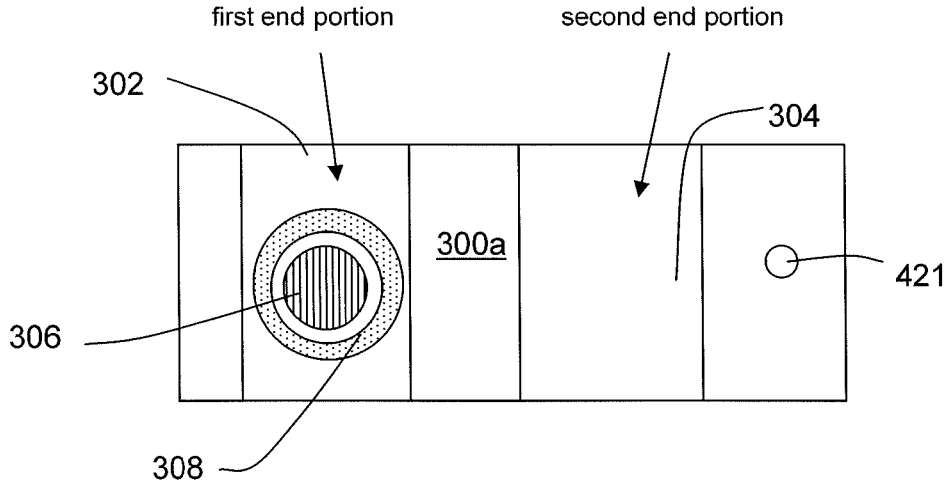
Figure 10:
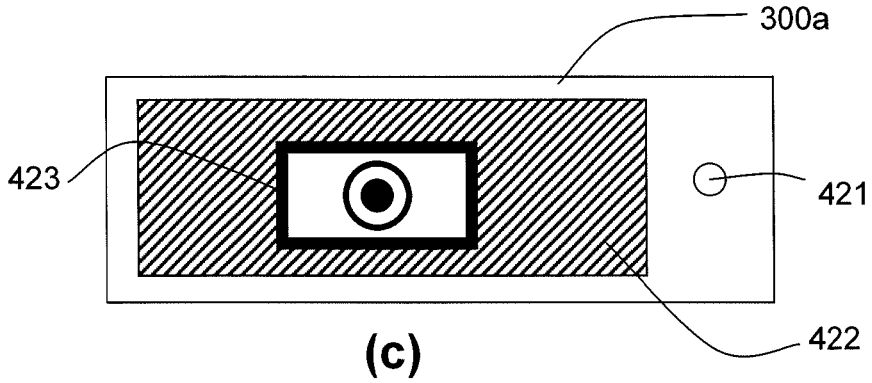

The upper stage of the button 17 is shown in FIG. 10 according to a profile view (*a*), bottom view (*b*) and top view (*c*). As can be seen more clearly in FIG. 10, the push key 300, the contact pad protrusion 302 and the broad surface 304 in this example are constructed as a single element comprising the same material. Within the contact switch region, both the conductive contact pad 306 and resilient ring 308 are attached to the contact pad protrusion 302 in this embodiment. In other embodiments, the resilient ring 308 may be fabricated as a portion of the push key 300 element, namely such that the resilient ring 308, the push key 300, the contact pad protrusion 302, and the broad surface 304 are constructed as a single element comprising the same material.

The resilient ring 308 comprises several functions that may be noted. The resilient ring 308 may be relied upon to support the weight of the push key 300 in order to prevent the contact pad 306 from engaging the contact gap 310 in the absence of an external force being applied. The resilient ring 308, therefore, should be strong enough to support the weight of the push key 300. After an external force has been applied to the button 17 and, then removed, the resilient ring 308 may function as a resilient member to return the push key 300 to a neutral or rest position, as shown in FIG. 9. The resilient ring 308, therefore, should have elastic physical properties, allowing the ring 308 to collapse and recover repeatedly. Also, due to the resilient properties of the resilient ring 308, the ring 308 can provide tactile feedback. Such feedback allows the user pressing the button to distinguish when the first stage (i.e. the contact pad switch) has been activated.

The resilient ring 308 may also function as a seal to prevent unwanted particles, such as dirt for example, from contaminating the gap between the contact pad 306 and the contact gap 310. It can be appreciated that the existence of particles between the contact pad 306 and contact gap 310 may prevent the two conductive surfaces from engaging, thereby preventing the electric switch from closing. As best shown in FIG. 9, the resilient ring 308 can be situated between the protruding surface 302 supported above and the underlying surface 312, thereby surrounding the contact pad 306 and contact gap 310.

It can be appreciated that the shape of the resilient ring 308 is not limited to any particular geometry. By way of example, the resilient ring may also take the shape of a triangle, square, or octagon or random shape. It can also be appreciated that the ring 308 may, in some embodiments, not be required to completely surround the perimeter of the contact pad 306. In other words, the ring 308 may be broken along certain segments, so long as the ring 308 resiliently separates the contact gap 306 and the contact pad 310 when the button 17 is in a rest position.

Various types of springs, including coil springs, may be used in the two-stage button 17. There may, however, be advantages to using a resilient ring 308 that comprise a reduction in noise level during use, a reduction in mechanical complexity, a decreased cost and a reduced profile height. A resilient ring 308 may create less noise during compression and decompression. Further, the mechanical simplicity of a resilient ring 308 may lead to longer usage over many cycles of compression and decompression. Moreover, the mechanical configuration of the resilient ring may decrease the manufacturing complexity and cost. A resilient ring 308 may also tend to require a lower profile, thereby decreasing the volume occupied by two-stage button 17. This may be desirable for various mobile devices where space may be limited.

As noted above, the resilient ring 308 may partially or completely surround the contact pad 306 depending on the application and environment in which the switch assembly is to be used. The contact pad 306 comprises an electrically conductive material such as, for example, copper or gold. A function of the contact pad 306 is to bridge the contact gap 310 and complete a circuit. It may be understood that the contact pad 310 may have various geometries, not limited to a circular shape as shown in FIG. 10.

As also noted above, the push key 300*a* in FIGS. 9 and 10 may be mechanically secured to the structure of a mobile device 100, such as the external casing 322, by using a structure, such as a heat staking structure 420. In one embodiment, as shown in FIGS. 9 and 10, the heat staking structure 420 protrudes towards the interior of the mobile device 100 and may be positioned through the hole 421, located towards the push key's 300*a* periphery. In an embodiment according to FIG. 10(*c*), the hole 421 is located to the side of the key cap 422, which in this embodiment comprises a graphic 423, to indicate in many cases a button's purpose to the user. Generally, the end portion of the heat staking structure 420 may be expanded into a knob-like formation through the application of heat, such that the knob-like formation is larger than the diameter of the hole 421. The expanded end portion of the heat staking structure 420 may be used to constrain the movement of the push key 300*a* along the length of the heat staking structure 420, thereby securing the push key 300*a* to the external casing 322. This constraint of movement may inhibit ejection of the push key 300*b*, e.g. when the mobile device 100 is dropped.

It can be appreciated that one or more heat staking structures 420 may be used to prevent the push key 300*a* from becoming dislodged from the external casing 322. Moreover, the push key 300*a* may use the heat staking structure 420 as a support to guide the collapsed push key 300*a* to return to its neutral position and form after the downward force acting on the push key 300*a* is removed. This method of securing the push key 300*a* may be suitable for configurations wherein the external casing 322, in a similar plane as the key cap 422, allows for a heat staking structure 420 to extend downwards through the push key 300*a*. Other methods of securing and supporting a push key 300 may also be used.

Figure 11:
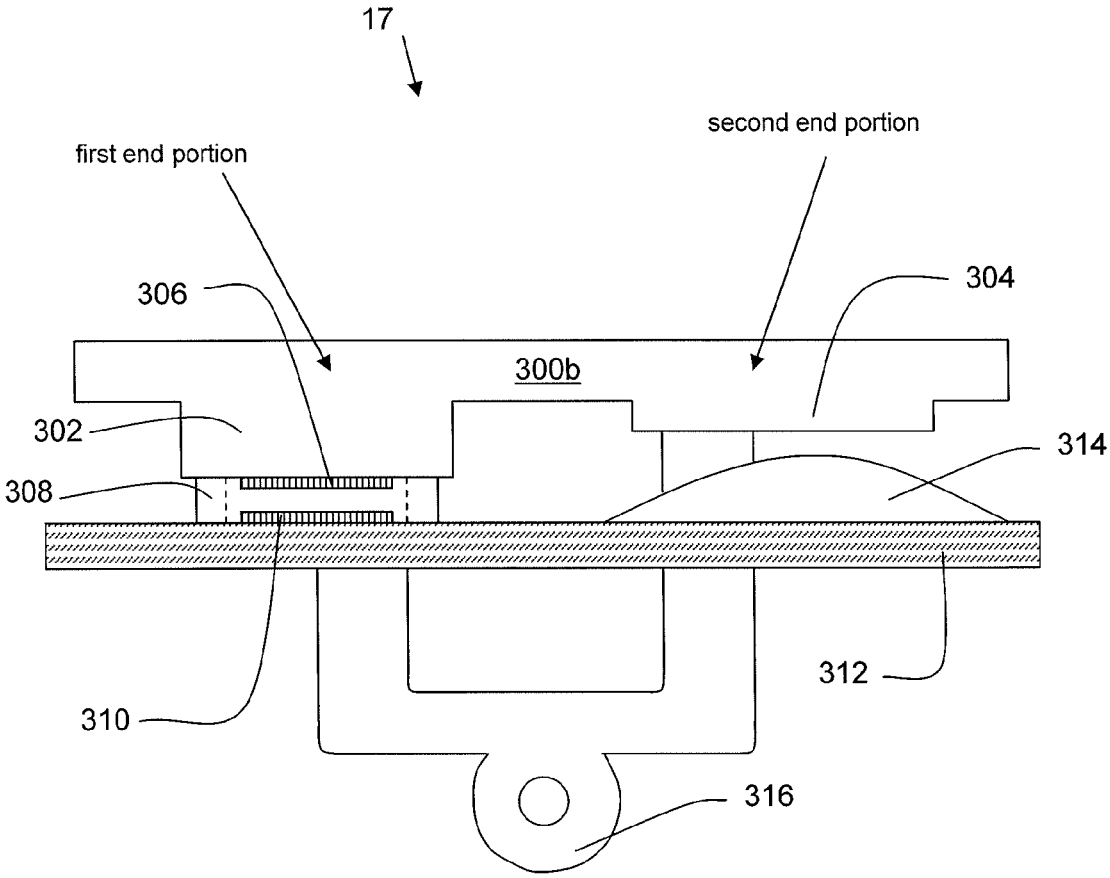
FIG. 11 is a profile view of another exemplary embodiment of a two-stage switch device.

Turning to FIG. 11, another embodiment of a two-stage camera button 17 is shown in a neutral or rest position, such embodiment comprising a dome switch and conductive pad switch arranged laterally in an array. The embodiment of FIG. 11 shows another configuration that allows the push key 300 to be secured to the mobile device 100. The conductive pad 306 and the dome switch 314 are activated by a common push key 300. The push key 300*b* shown here has a broad outwardly facing (exterior) surface that may be used to receive a force for activating the camera button 17. The push key 300*b* also comprises a protruding locking ring 316. Further detail regarding the application of the locking ring is discussed below. It may be noted that the push key 300*b* in this embodiment may not be secured to a rigid key cap 422, and the top surface of the resilient push key 300*b* may be used to receive pushing forces.

Figure 12:
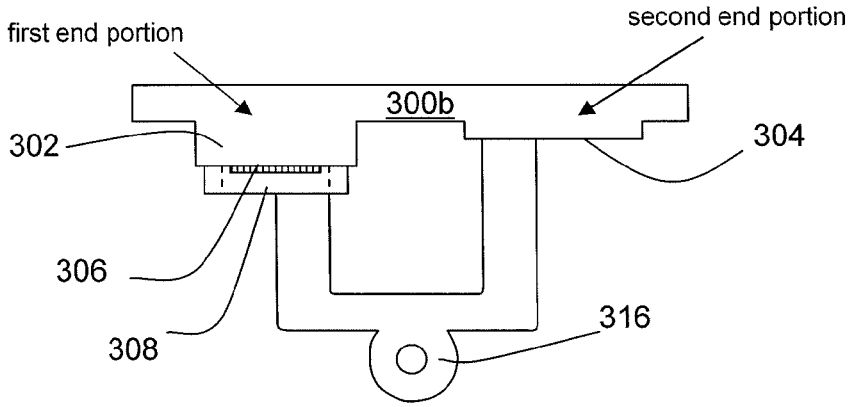
FIG. 12(*a*) is a profile view of the push key shown in FIG. 11 in isolation.
Figure 12:
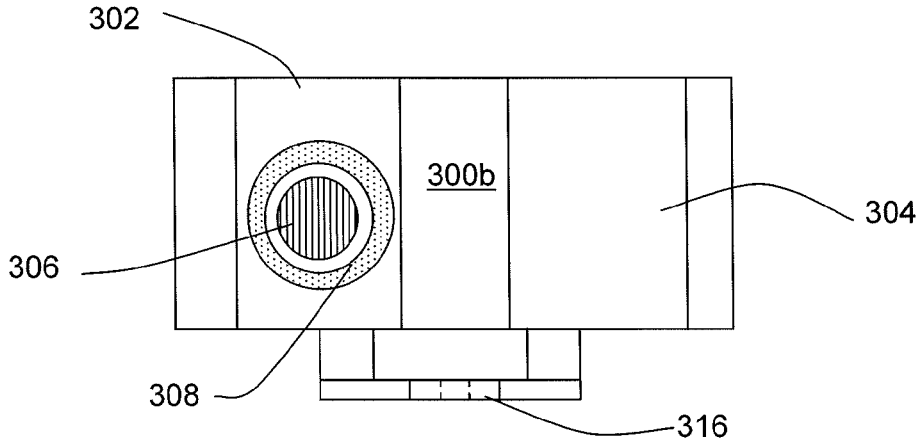
Figure 12:
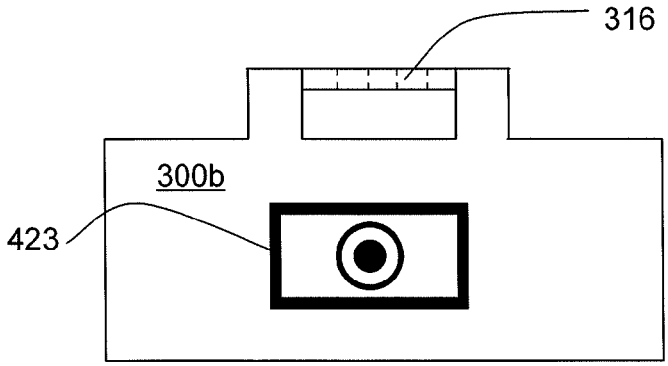

The upper stage of the button 17, according to FIG. 11, is shown in FIG. 12 shown in a profile view (*a*), bottom view (*b*) and top view (*c*). As can be seen more clearly in FIG. 12, the push key 300*b*, the contact pad protrusion 302, the broad surface 304 and the locking ring 316 in this example are constructed as a single element comprising the same material. Within the contact switch region, both the conductive contact pad 306 and resilient ring 308 are attached to the contact pad protrusion 302 in this embodiment. In another embodiment, the resilient ring 308 is fabricated as a portion of the push key 300*b* element, namely such that the resilient ring 308, the push key 300*b*, the contact pad protrusion 302, the broad surface 304 and the locking ring 316 are constructed as a single element comprising the same material.

Figure 13:
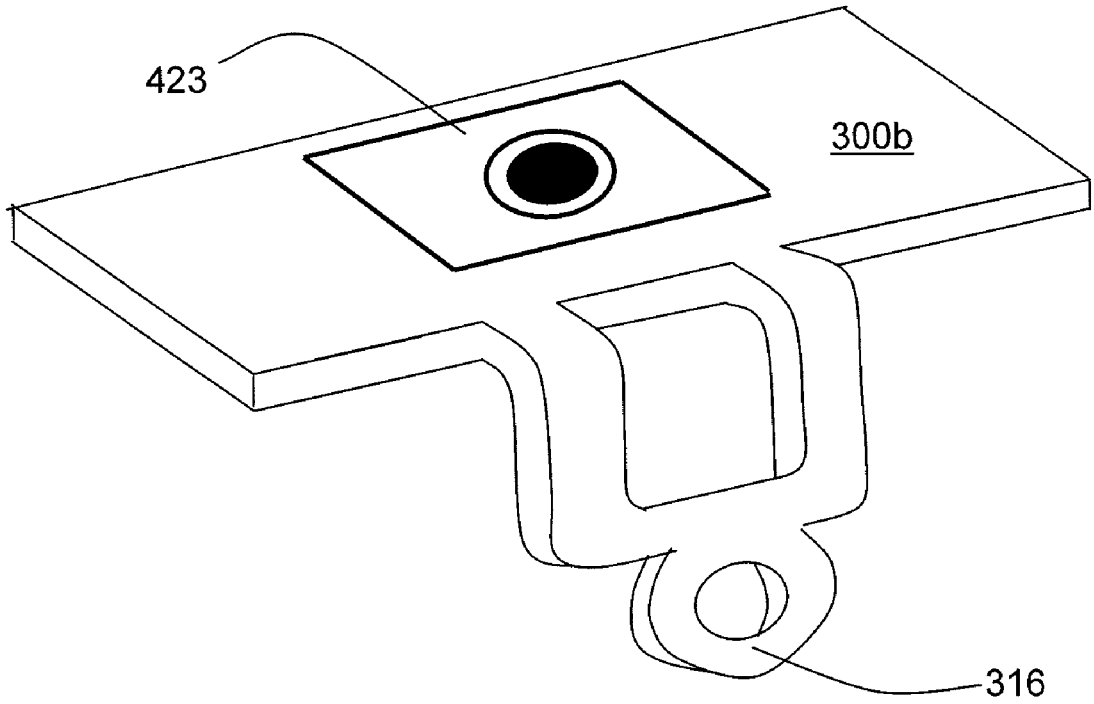
FIG. 13 is a rear perspective view of the push key shown in FIGS. 12(*a*) to 12(*c*).

As also noted above, the push key 300*b* in FIG. 11 may be mechanically secured to the structure of a mobile device by using the locking ring 316. In one embodiment, as shown in FIGS. 12 and 13, the locking ring 316 may protrude from the main push key surface 300*b* through two extending arms that are curved substantially perpendicular to the main push key surface 300*b*. Alternatively, in other embodiments, the locking ring 316 may, for example, protrude from the main push key surface 300*b* through a single arm or utilize any other suitable support. The arms, or connecting structure between the locking ring 316 and push key 300*b*, may comprise resilient material able to deform, flex or bend. In one embodiment, the arms may comprise the same resilient material as the locking ring 316 and push key 300*b*. Further, it may be noted that the geometry of the locking ring 316 should not be limited to a circular shape and may have various different forms.

Figure 14:
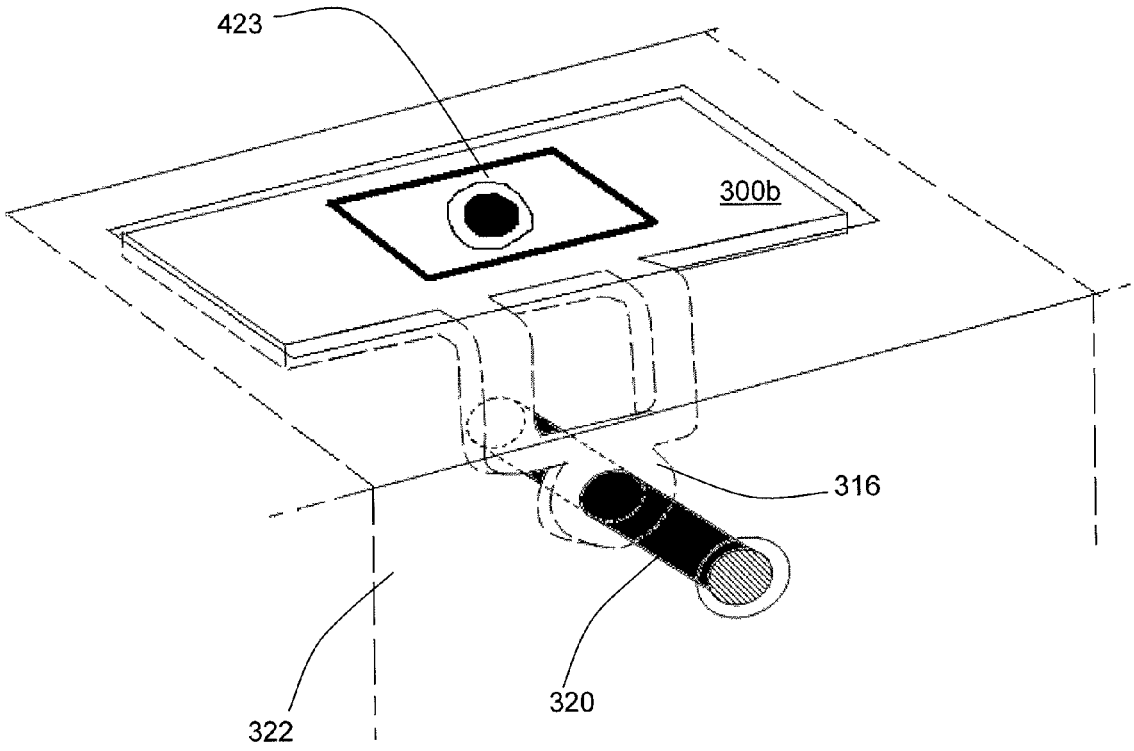
FIG. 14 is a perspective view of the two-stage-switch used in the mobile device shown in FIG. 11.

Referring now to FIG. 14, the push key 300*b* is shown relative to the external casing 322 of a mobile device 100. The upper surface of the push key 300*b* is exposed and generally aligned with the mobile device casing 322 to allow a user to press down on the key 300*b*. Located below the push key 300*b*, although not shown in FIG. 14, is the lower surface 312 on which the contact gap 310 and dome switch 314 are situated. A locking post 320 protrudes from the mobile device casing 322 and extends through the locking ring 316, thereby constricting movement of the push key 300*b* to inhibit ejection of the push key 300*b*, e.g. when dropped. The locking post 320 may comprise a rigid or partially rigid material.

The combination of a locking ring 316 and locking post 320 reduces the mode of mechanical failure in which a push button or key may break-off a mobile device 100. Breakage of the push key may occur when a mobile device 100 receives a sudden force such as, for example, the impact force resulting from dropping the device onto a hard surface. In this example, the locking ring 316 and locking post 320 can resist the impact force and, as a result, may prevent the push key 300 from dislodging.

Figure 15:
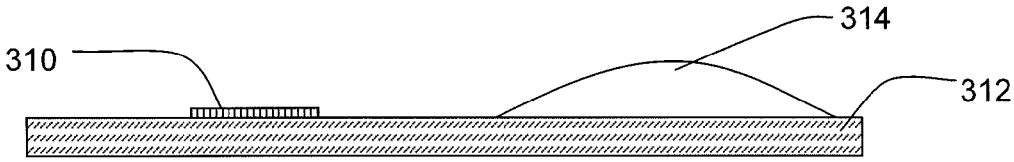
FIG. 15(*a*) is a profile view of the lower surface shown in FIG. 9 and FIG. 11 in isolation.
Figure 15:
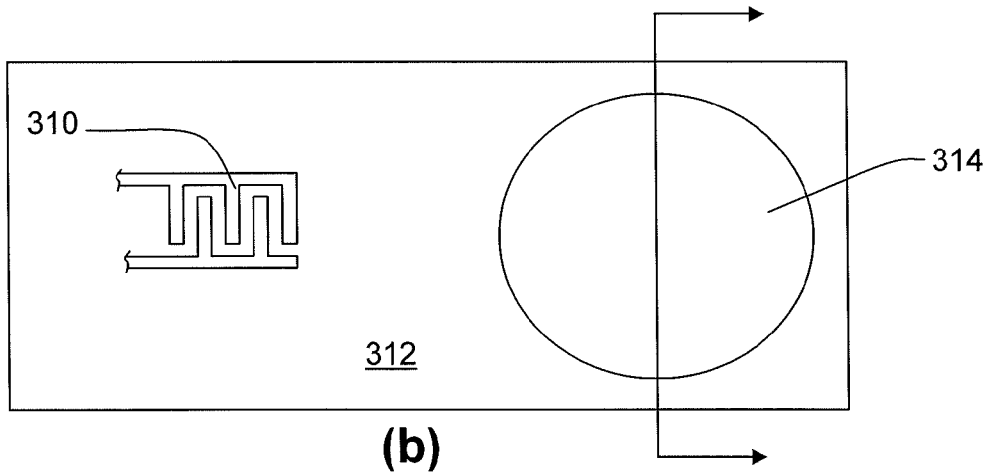

Turning to FIG. 15, the underlying surface 312 may be embodied as a platform supporting a contact gap 310 and a dome switch 314. The contact gap 310 and dome switch 314 are positioned adjacent to one another, such that the contact gap 310 is aligned with the contact pad 306 and the dome switch 314 is aligned with the broad surface 304. In one embodiment, the lower surface 312 may comprise a printed circuit board on which the circuit gap 310 is printed. The circuit gap 310 comprises two electrically conductive terminals that are electrically isolated from one another, such as by way of a physical space or gap. In one embodiment, as illustrated in FIG. 15, the terminals may be designed to have several interlocking fingers in order to increase the surface area for electrical connectivity when in contact with the above contact pad 306. Other conductive terminal designs known in the art may also be applied.

It can be appreciated that the contact gap 310 is not limited to a configuration comprising two conductive terminals and may instead, for example, comprise a single conductive terminal. For example, the contact pad 306 may comprise a single conductive terminal to engage another single conductive terminal located in the contact gap 310. Alternatively, in yet another example, the above contact pad 306 may comprise two conductive terminals that are to be bridged by the lower contact gap 310. Therefore, in general, as the contact pad 306 on the push key 300 engages the lower contact pad 310, two conductive terminals of any configuration may be connected.

Figure 16:
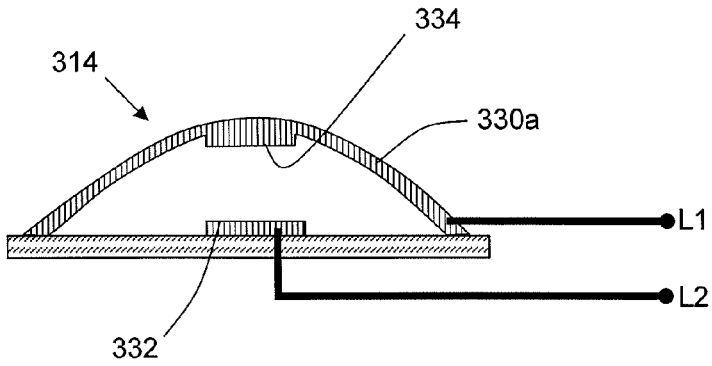
FIG. 16 is a cross-sectional view of a metal dome shown in FIGS. 15(*a*) to 15(*b*).

The dome switch 314 in this example is adjacent to the contact gap 310. The dome switch 314 is a single-action mechanism that connects a set of contact terminals upon receiving a force. Referring to FIG. 16, a cross-section of one embodiment of a dome switch 314 is shown. The dome 314 in one embodiment may comprise a metal dome shell 330*a* that is able to be collapsed and resiliently recover over many cycles, and maintain its shape in the absence of a applied downward force. The metal dome shell 330*a* comprises electrically conductive material. Located on the inner side of the dome shell 330*a*, at the apex, is a dome contact pad 334 aligned with a contact terminal pad 332 located directly below the dome's apex. In this example, the dome contact pad 334 and metal dome shell 330*a* comprise the same material. An electrical lead L1 may be connected to the metal dome shell 330*a*, while another electrical lead L2 may be connected to the contact terminal pad 332. Upon receiving an applied downward force, the metal dome shell 330*a* collapses inwardly and thereby lowers the apex of the dome towards and then into engagement with the contact terminal pad 332. When the apex engages the terminal pad 332, the electric leads L1 and L2 may be connected thereby actuating the second stage of the switch.

It can be appreciated that a metal dome shell 330*a* may generally require larger forces to collapse the dome shell 330 over non-metallic dome shells 330*b*. A larger force may provide more distinct tactile feedback between activating the contact pad switch and the dome switch.

Figure 17:
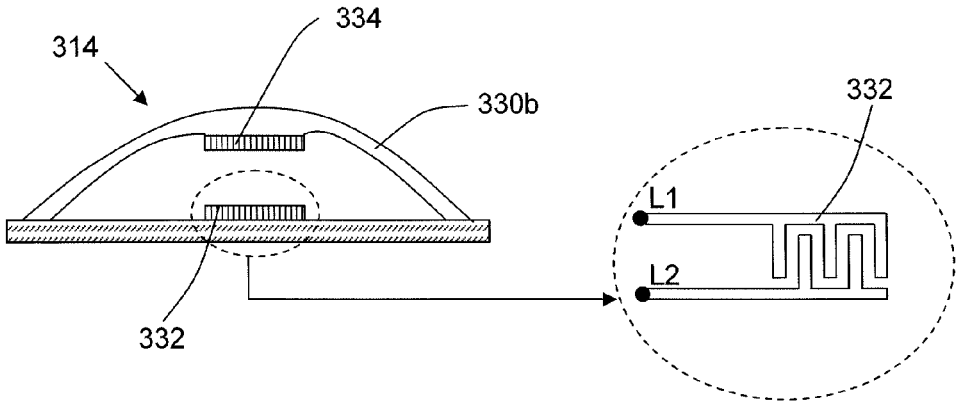
FIG. 17 is a cross-sectional view of a non-metal dome shown in FIGS. 15(*a*) to 15(*b*).

FIG. 17 shows another embodiment of a dome switch 314, wherein the dome switch 314 may comprise a non-metal resilient dome shell 330*b* that is able to be collapsed and resiliently recover over many cycles, and maintain its shape in the absence of a applied downward force. The non-metal resilient dome shell 330*b* may comprise, for example, various plastic or rubber materials. Located on the inner side of the dome shell 330*b*, at the apex, is a dome contact pad 334 for the dome 314 comprising an electrically conductive material. Located below and aligned with the dome contact pad 334 is a contact terminal pad 332, which may comprise two electrical leads L1 and L2 that are electrically isolated by way of a physical space or gap. Upon receiving an applied downward force, the resilient dome shell 330*b* collapses inwardly and thereby lowers the apex of the dome and the attached dome contact pad 334 towards and then into engagement with the contact terminal pad 332. When the contact pad 334 engages the terminal pad 332, electrical leads L1 and L2 are connected and an electric circuit may be completed thereby actuating the second stage of the switch. In general, when a dome shell 330 collapses, two electrical leads are connected.

It may also be appreciated that various combinations of types of dome switches 300, methods to secure the push key 300, and options for using a key cap 422 are equally applicable to the two-stage button 17.

In the general configuration described above, the two-stage button 17, as shown in FIGS. 9 and 11, operates by first activating the contact switch region followed by the dome switch region. In the first stage, the push key 300 receives a force that presses the contact pad 306 against the contact gap 310 to close an electric circuit, thereby activating the camera focusing function. In the second stage, without removing the first applied force, the push key 300 receives a second force that is greater than the first force. Under this greater force, the broad surface 304 presses down against the top of the dome switch 314, which as a result completes a circuit connected to the dome switch and activates the camera shutter. When the applied force on the push key 300 is removed, then the push key returns to its neutral or rest position. The neutral or rest position, shown in FIGS. 9 and 11, comprises the contact pad 306 having no contact with contact gap 310 and the dome switch 314 uncompressed.

Figure 18:
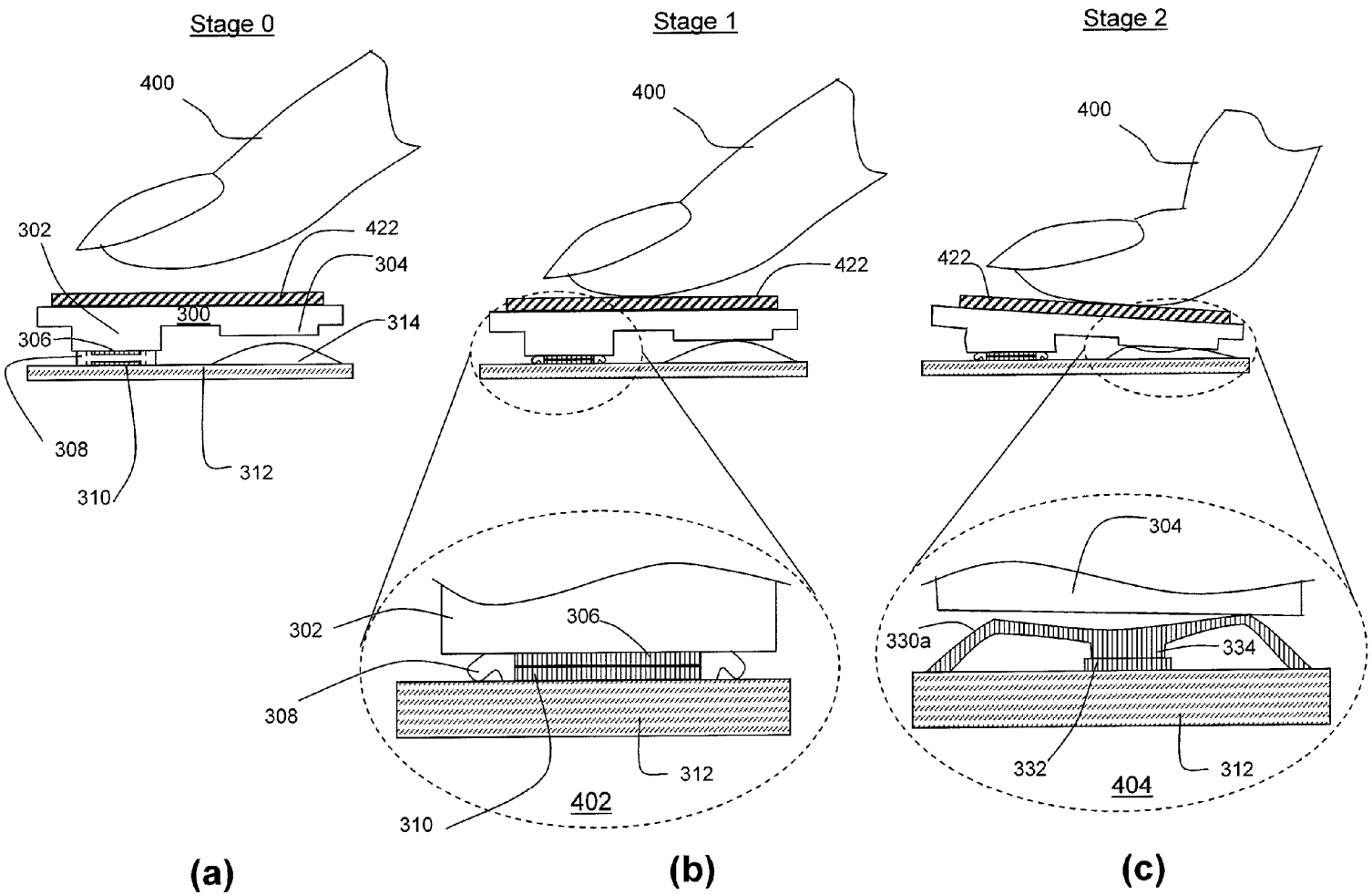
FIGS. 18(*a*) through 18(*c*) illustrate exemplary stages of operating the two-stage switch shown in FIG. 9.

Referring now to FIG. 18, the stages of operation of the two-stage button 17, comprising a rigid key cap 422 and metal dome shell 330*a*, are shown in greater detail using a series of cross-sectional views. In this embodiment, there are three stages in the operation of the button 17, the first stage (Stage 0) being a neutral or rest position. In Stage 0, neither of the switches in the switch array are activated (i.e. both are at rest) and the button 17 is also at rest. In Stage 1, only the contact pad switch is activated. In Stage 2, the contact pad switch and the dome switch 314 are both activated.

In Stage 0, no force is applied to the key cap 422. The resilient ring 308 supports the weight of the push key 300, separating the contact pad 306 from the contact gap 310, which also can prevent the dome switch 314 from being collapsed. As noted above, the heat staking structure 420 or locking ring's 316 arms may also be used to provide support for the push key 300.

In Stage 1, the user then applies a first downward force that acts on the key cap 422. The key cap 422 may receive the force from a user that is exerting the pressing force using a finger 400 as shown in FIG. 18. The first force is transmitted through the key cap 422 and over the surface of the push key 300, wherein the push key 300 then acts upon the resilient ring 308. The resilient ring 308 is compressed leading to the deformation of the resilient ring 402. In the deformed state, the reduced height of the resilient ring 308 allows the contact pad 306 and contact gap 310 to touch, thereby completing the first circuit and activating the camera focusing function. In the configuration shown, the first force required to compress the resilient ring 308 is relatively small, e.g. may feel to a user like a firm "touch". Once the contact pads 306 and 310 have engaged, the switch may provide feedback that feels similar to an immediate hard stop. Such feedback allows the user to recognize that two-stage button 17 has activated Stage 1.

Also, in Stage 1, while the finger 400 maintains contact with the key cap 422 and maintains the first force, the apex of the erect dome switch 314 may or may not be in contact with the push key's broad surface 304. In the case where the broad surface 304 is touching the dome switch 314, as shown in Stage 1 of FIG. 18, the push key surface 300 within the dome switch region would not yet be exerting a sufficient downward force to collapse the dome switch 314.

In Stage 2, an increased force is experienced, namely, a second force received by the key cap 422 in Stage 2 is greater than the first force received in Stage 1. When the key cap 422 receives the second force, the vertical position of the push key 300 within the contact pad switch region remains unchanged because the lower surface 312 is supporting the push key 300 via the contact gap 310 and contact pad 306. However, the vertical position of the push key 300 decreases in the dome switch region because of the second greater force. The rigid key cap 422 and attached push key 300 pivots downwards around the contact pad switch region. The pivot motion allows the push key 300 in the dome switch region to travel downward. The second force is transmitted through the push key's broad surface 304, which in turn acts on the dome switch 314 and thereby collapses the dome switch shell 330. In this situation 404, the metal dome shell 330*a* collapses to touch the corresponding terminal pad 332. The dome switch connection in Stage 2 may activate a second function, such as a camera shutter.

As noted, during Stage 2, the user may exert a second force that is greater than the first force by pressing down harder. In one embodiment, as the user's finger 400 bends, the area of the finger 400 in contact with the push key 300 may increase and, moreover, slide into the dome switch region. The sudden compression of the dome switch 314 and contact stop between the contact pad 334 and gap 332 can be felt by the user. In some cases, the user may feel a pivoting motion in the rigid key cap 422 as the dome switch 314 collapses. This reinforces through tactile feedback that Stage 2 of the switch activation process has occurred. In general, the method in which a user exerts a pressing force on to the two-stage button may vary.

After the user removes the finger 400 from the push key 300, then the absence of an applied downward force allows the dome switch 314 and resilient ring 308 to decompress and return to their neutral or rest position (i.e. Stage 0).

Figure 19:
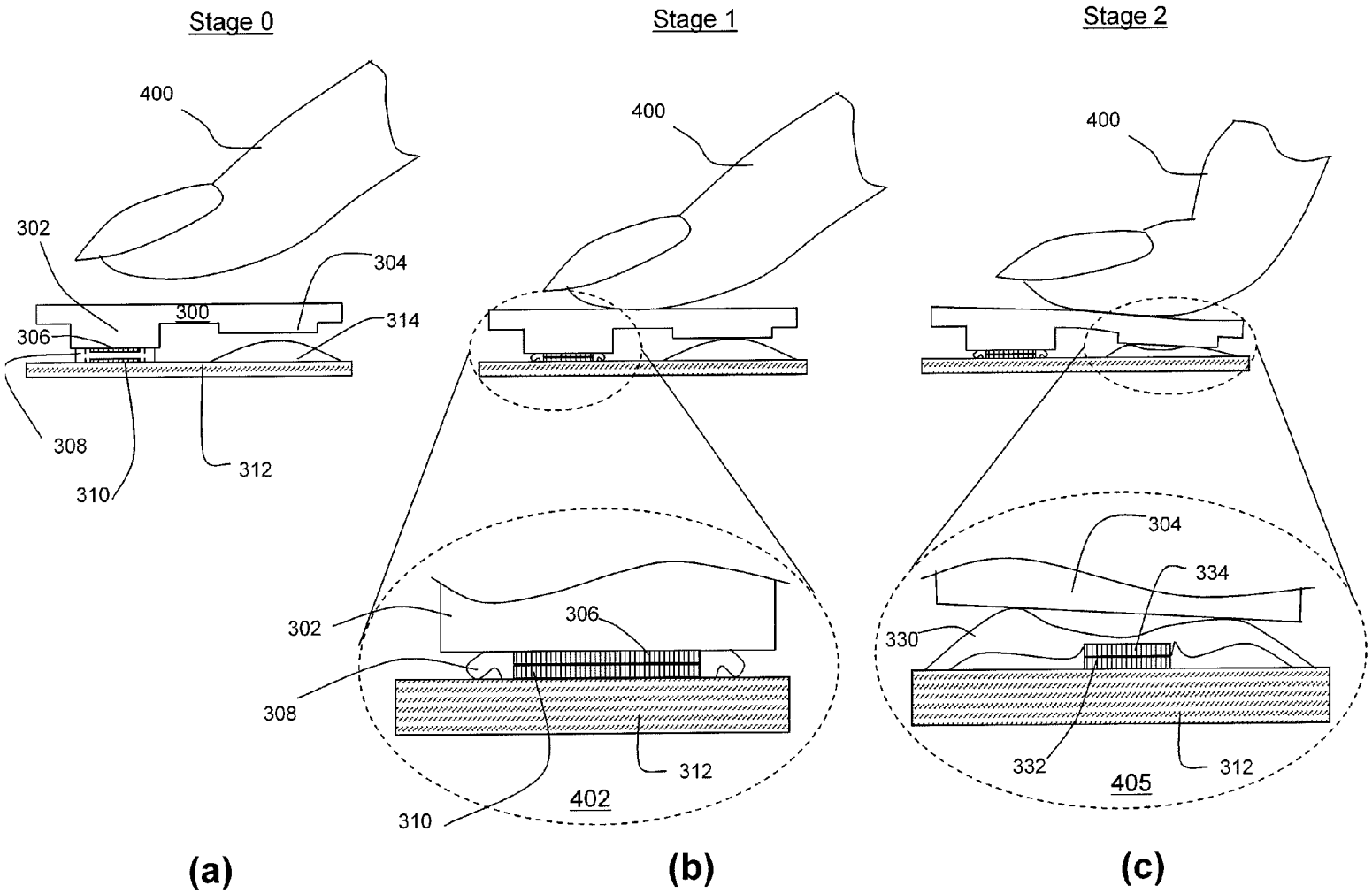
FIGS. 19(*a*) through 19(*c*) illustrate exemplary stages of operating the two-stage switch shown in FIG. 11.

FIG. 19 shows another embodiment of a two-stage button 17 and the actions within Stage 0, Stage 1 and Stage 2. In this embodiment, the push key 300 is not attached to a rigid key cap 422, and may flex. The actions may vary in Stage 2, when the push key 300 receives the second force. The vertical position of the push key 300 within the contact pad switch region remains unchanged because the lower or underlying surface 312 is supporting the push key 300 via the contact gap 310 and contact pad 306. However, the vertical position of the push key 300 decreases in the dome switch region because of the second greater force. As the second force is transmitted through the push key 300, a bending moment is created along the push key 300. Due to the resiliency of the push key's material, the push key 300 in the dome switch regions flexes downward. The second force is transmitted through the push key's broad surface 304 and thus, collapses the dome switch 314. In this situation 405, the non-metal dome shell 330 resiliently deforms and causes the internal contact pad 334 to touch the corresponding terminal leads 332. During Stage 2, the user in some cases may feel the resilient push key 300 flex as the dome switch 314 collapses.

The configurations exemplified above, wherein a pair of switches are laterally positioned adjacent to one another, may afford several perceived advantages. The contact pad and dome switches used in the button 17 as described herein can reduce misalignment by using broad surfaces that are positioned close to the corresponding switching device. By having two broad surfaces 302, 304 on the push key 300 that are positioned adjacent to one another, the increased surface area of each switch may increase the likelihood of proper alignment. Furthermore, the vertical distance between the contact pad 306 and contact gap 310, as well as between the broad surface 304 and the dome switch 314, is relatively small and can thus further reduce the chance of misalignment. The vertical distance between the contact pad 306 and contact gap 310 in one embodiment may be in the order of, for example, 1 millimeter.

Another perceived advantage of the contact pad and dome switches used in the button 17 is a reduced profile. Laterally positioning the switch mechanisms as described herein can decrease the profile of the button 17 and overall switch assembly, which may be preferred for mobile devices that have limited space. It can also be seen in FIG. 15 that low profile components may be selected to achieve the lower profile noted above. For example, as discussed earlier, a resilient ring 308 tends to have a low profile height and, as such, using a resilient ring 308 can reduce the overall profile height of the two-stage button 17.

Yet another perceived advantage of the contact pad and dome switches used in the button 17 as shown is the tactile feedback provided. By having the two switches physically isolated from one another through lateral placement, the user experiences two distinct tactile responses from the button 17, each originating from a different location. In Stage 1, the user receives a hard-stop tactile signal in the location directly above the contact pad switch region. In Stage 2, the user receives a separate sensation of tactile feedback comprising of the push key 300 bending downwards or flexing over the dome switch 314, and the push key 300 reaching a second hard stop in the dome switch region. This distinct tactile feedback may be accomplished using several components which are mechanically robust.

It will be appreciated that the tactile experience for a user may vary according to a range of factors including, but not limited to, the size of the finger 400, the size of the button 17, and the way in which the user presses down on the button 17.

It will be appreciated that the particular embodiments shown in the figures and described above are for illustrative purposes only and many other variations can be used according to the principles described. Although the above has been described with reference to certain specific embodiments, various modifications thereof will be apparent to those skilled in the art as outlined in the appended claims.

The invention claimed is:

1. A mobile device comprising a switch assembly, the switch comprising:

a dome switch;

a conductive pad switch arranged laterally in an array relative to the dome switch, the conductive pad switch comprising an upper contact and a lower contact, and a resilient member surrounding the upper and the lower contacts and acting to separate the upper and the lower contacts; and a push key positioned above the array and comprising a hole to receive a heat staking structure, wherein upon movement of the push key, the resilient member deforms to close the conductive pad switch under a first force, while a second force greater than the first force closes the dome switch.

2. A camera device comprising a lens, a camera shutter, and a switch assembly for focusing an image entering the lens and activating the camera shutter, the switch assembly comprising:

a dome switch;

a conductive pad switch arranged laterally in an array relative to the dome switch, the conductive pad switch comprising an upper contact and a lower contact, and a resilient member surrounding the upper and the lower contacts and acting to separate the upper and the lower contacts; and a push key positioned above the array and comprising a hole to receive a heat staking structure, wherein upon movement of the push key, the resilient member deforms to close the conductive pad switch under a first force thereby focusing the image entering the lens, while a second force greater than the first force closes the dome switch thereby activating the camera shutter to capture the image.

3. A mobile device comprising the camera device according to claim 2.

4. A switch assembly comprising:

a dome switch;

a conductive pad switch arranged laterally in an array relative to the dome switch, the conductive pad switch comprising an upper contact and a lower contact, and a resilient member surrounding the upper and the lower contacts and acting to separate the upper and the lower contacts; and a push key positioned above the array and comprising a hole to receive a heat staking structure, wherein upon movement of the push key, the resilient member deforms to close the conductive pad switch under a first force, while a second force greater than the first force closes the dome switch.

5. The switch assembly according to claim 4 wherein the hole to receive the heat staking structure is for securing the push key to a device.

6. The switch assembly according to claim 4 wherein the hole to receive the heat staking structure is located towards the push key's periphery.

7. The switch assembly according to claim 4 wherein the resilient member is formed as a portion of the push key.

8. The switch assembly according to claim 4 wherein the resilient member provides a seal around the periphery of the upper contact and the lower contact.

9. The switch assembly according to claim 4 wherein the top of the dome switch comprises a puck.

10. The switch assembly according to claim 4 wherein the resilient member is any one of ring-shaped, triangle-shaped, square-shaped and octagon-shaped.

11. The switch assembly according to claim 4 wherein the push key comprises a first end portion positioned above the conductive pad switch and a second end portion positioned above the dome switch.

12. The switch assembly according to claim 4 wherein the hole to receive the heat staking structure is for securing the push key to the mobile device.

13. The switch assembly according to claim 4 wherein a rigid key cap is attached to the top of the push key.

14. The switch assembly according to claim 13 wherein a hard-stop protrusion is spaced below the key cap and is positioned in the vicinity of the conductive pad switch in the array.

15. The switch assembly according to claim 13 wherein the push key further comprises a hole to receive a heat staking structure and the hole is located towards the push key's periphery and to one side of the key cap.

16. The switch assembly according to claim 4 wherein the push key comprises a first end portion positioned above the conductive pad switch and a second end portion positioned above the dome switch.

17. The switch assembly according to claim 16 wherein the push key further comprises a resilient material to permit movement of the second end portion with respect to the first end portion.

18. The switch assembly according to claim 16 wherein the push key further comprises a resilient material to permit movement of the second end portion with respect to the first end portion.

19. The switch assembly according to claim 16 wherein the first end portion comprises a first protrusion for supporting the upper contact and the second end portion comprises a second protrusion for closing the dome switch.

20. The switch assembly according to claim 16 wherein the first end portion comprises a first protrusion for supporting the upper contact and the second end portion comprises a second protrusion for closing the dome switch.

21. The switch assembly according to claim 20 wherein the resilient member is attached to the first protrusion.

* * * * *